US008241082B2

(12) United States Patent
Guthrie et al.

(10) Patent No.: US 8,241,082 B2
(45) Date of Patent: Aug. 14, 2012

(54) ELECTRODE-LESS INCANDESCENT BULB

(75) Inventors: Charles Guthrie, San Jose, CA (US); Donald Wilson, San Jose, CA (US); Floyd Pothoven, Lakewood, CA (US); Eddie Odell, Leicester (GB); Robin Devonshire, Sheffield (GB)

(73) Assignee: Ceravision Limited, Milton Keynes (GB)

( * ) Notice: Subject to any disclaimer, the term of this patent is extended or adjusted under 35 U.S.C. 154(b) by 144 days.

(21) Appl. No.: 11/794,490

(22) PCT Filed: Dec. 23, 2005

(86) PCT No.: PCT/GB2005/005080

§ 371 (c)(1),
(2), (4) Date: May 7, 2008

(87) PCT Pub. No.: WO2006/070190

PCT Pub. Date: Jul. 6, 2006

(65) Prior Publication Data

US 2008/0227359 A1 Sep. 18, 2008

(51) Int. Cl.
*H01J 9/00* (2006.01)

(52) U.S. Cl. ..... 445/43; 445/42

(58) Field of Classification Search ..... 445/8, 26, 445/38, 53, 42, 43

See application file for complete search history.

(56) References Cited

U.S. PATENT DOCUMENTS

| | | | | |
|---|---|---|---|---|
| 3,421,804 | A * | 1/1969 | Taxil | 445/18 |
| 3,572,877 | A | 3/1971 | Ogawa et al. | |
| 5,404,076 | A | 4/1995 | Dolan et al. | |
| 5,519,285 | A * | 5/1996 | Ukegawa et al. | 313/594 |
| 6,680,571 | B1 * | 1/2004 | Giorgi et al. | 313/565 |
| 6,737,809 | B2 | 5/2004 | Espiau et al. | |
| 2001/0000941 | A1 * | 5/2001 | Chandler et al. | 313/46 |
| 2002/0167282 | A1 | 11/2002 | Kirkpatrick et al. | |

FOREIGN PATENT DOCUMENTS

| | | |
|---|---|---|
| JP | 58169754 | 10/1983 |
| JP | 05205641 | 8/1993 |
| JP | 09199033 | 7/1997 |
| WO | WO 02/47102 | 6/2002 |

OTHER PUBLICATIONS

Machine Translation of JP 09199033.*
Machine Translation of JP 09199033, Published Jul. 31, 1997.*

* cited by examiner

*Primary Examiner* — Toan Ton
*Assistant Examiner* — Andrew Coughlin
(74) *Attorney, Agent, or Firm* — Bay State IP, LLC

(57) ABSTRACT

A method of making an electrodeless incandescent bulb comprises the steps of:
providing a bulb tube of quartz glass,
closing one end of the bulb tube,
forming a neck having a bore less than the internal diameter of the bulb tube,
inserting a pellet of excitable material into the bulb tube through the adjacent neck,
evacuating the bulb tube through the neck and
sealing the bulb.

7 Claims, 6 Drawing Sheets

ELECTRODE-LESS INCANDESCENT BULB

CROSS REFERENCE TO RELATED APPLICATIONS

This application is the U.S. National Stage of International Application Number PCT/GB05/005080 filed on Dec. 23, 2005 which was published in English on Jul. 6, 2006 under International Publication Number WO 2006/070190.

TECHNICAL FIELD

The present invention relates to an electrodeless incandescent bulb.

BACKGROUND OF THE INVENTION

Electric lamps generally comprise either an incandescent ohmic filament bulb and suitable fittings or a discharge bulb usually with electrodes for exciting the discharge. The resultant radiation is not always visible, in which case, the bulb is lined with phosphorescent material to provide visible light. It is known also to provide a bulb without electrodes and to excite it by applying external radiation, in particular microwave energy.

An electrodeless lamp using a microwave source is described in U.S. Pat. No. 6,737,809, in the name of FM Espiau et al., the abstract of which is as follows:

A dielectric waveguide integrated plasma lamp with a body consisting essentially of at least one dielectric material having a dielectric constant greater than approximately 2, and having a shape and dimensions such that the body resonates in at least one resonant mode when microwave energy of an appropriate frequency is coupled into the body. A bulb positioned in a cavity within the body contains a gas-fill which when receiving energy from the resonating body forms a light-emitting plasma.

Despite reference to a "bulb", this specification does not describe a discrete bulb, separable from the lamp body.

In our earlier International Patent Application, published under No WO 02/47102, we described:

A lamp has a body of sintered alumina ceramic material and an artificial sapphire window. The body is initially moulded in green state and the window is pressed into a front recess. The combination is fired at a temperature of the order of 1500° C., to fuse the body into a coherent pressure-tight state with the window. After partial cooling to the order of 600° C., a pellet of excitable material is added through a rear, charging aperture. A disc of ceramic with frit is placed over the aperture. The disc is irradiated by laser to fuse the frit and the disc to the body, thus sealing the excitable material into the lamp.

SUMMARY OF THE INVENTION

The object of the present invention is to provide an improved method of making an electrodeless incandescent bulb.

According to the invention there is provided a method of making an electrodeless incandescent bulb, the method comprising the steps of:

providing a bulb enclosure of quartz glass, forming an adjacent neck having a bore less than a transverse internal dimension of the bulb enclosure either:

integrally with the bulb enclosure or in a branch tube opening into the bulb enclosure, inserting at least one pellet of excitable material into the bulb enclosure through the adjacent neck, evacuating the bulb enclosure through the adjacent neck and sealing the bulb.

We have found that advantageous effects can be obtained by use of a mix of excitable elements. Accordingly, the pellet insertion step may include insertion of more than one pellet.

Whilst other shapes such as spherical can be envisaged, preferably, the enclosure is a tube and the method includes the step of closing off at least one opening in the bulb tube and wherein the step of forming the adjacent neck includes:

formation of the neck remote from the closed end in the case of the adjacent neck being formed integrally in the bulb or closing off the other end of the bulb enclosure end in the case of the adjacent neck being formed in a branch tube.

Preferably, the adjacent neck is formed and positioned with respect to the central axis of the bulb tube such that with the bulb tube, or the other tube, horizontal the pellet would have to roll upwards in order to enter the bore of the adjacent neck. The arrangement is such that the pellet can pass through the neck and yet can be restrained from rolling along the tube by the neck and retained remote from the other end of the tube during sealing.

Normally, the central axis of the adjacent neck will be co-incident, at least at an intersection point, with the central axis of the bulb tube.

Preferably:

the bulb is sealed at the adjacent neck;

the bulb tube, or the other tube where provided, is formed with a further neck remote from the adjacent neck, and the bulb tube, or the other tube, is preliminarily sealed at the further neck, prior to final sealing of the bulb at the adjacent neck.

Where two necks are provided, the first seal can be made at the outer neck, with a second seal being made subsequently at the inner neck, the portion of the tube between the necks being broken off and discarded.

In certain embodiments, the one end of the bulb tube is sealed by closure of the bulb tube with its own material. This end can be ground flat or ground to form a lens. Similarly, the other end can be sealed with the tube's own material and ground flat or to lens shape.

In other embodiments, the one end of the bulb tube is sealed by fusion of an additional piece to the end of the bulb tube. The additional piece can be flat circularly curved—preferably on both surfaces—or lens shaped. Where the branch tube is provided, the other end similarly can be sealed by fusion on of a flat or other shaped additional piece.

In other embodiments again, the bulb may be integrally form by blowing, and attached to a tube at a neck.

Normally the method will include:

an additional step of filling the bulb tube with inert gas, preferably a noble gas, after evacuation and prior to sealing.

Whilst providing an appreciable length of tube between the adjacent neck and the further neck enables the amount of gas being sealed into the bulb to be predicted; where the gas has a high enough boiling point, such as krypton, it may be condensed at the end of the bulb tube remote from the seal being effected at the adjacent neck by application of liquid nitrogen to the remote end of the bulb.

Further the method can include:

a preliminary step of precision boring the bulb tube; and a preliminary step of centrelessly grinding and polishing the bulb tube.

However, in certain embodiments, precision drawn quartz tube can be used.

Preferably:

the excitable material is metal halide material;

the pellet or pellets of excitable material is of a size to provide an excess of the material when vaporised to form a saturated atmosphere of the material in the bulb; and the method includes the formation of a slight convexity without appreciable concavity inside the seal at the adjacent neck, to avoid both the formation of a spigot liable to overheat or a recess liable to form a cold spot away from the plasma such as to cause the bulk of the excitable material to condense there in use.

According to another aspect of the invention, there is provided an electrodeless incandescent bulb made in accordance with the method of the first aspect.

BRIEF DESCRIPTION OF THE DRAWINGS

To help understanding of the invention, specific embodiments thereof will now be described by way of example and with reference to the accompanying drawings, in which.

DETAILED DESCRIPTION

Figure 1:
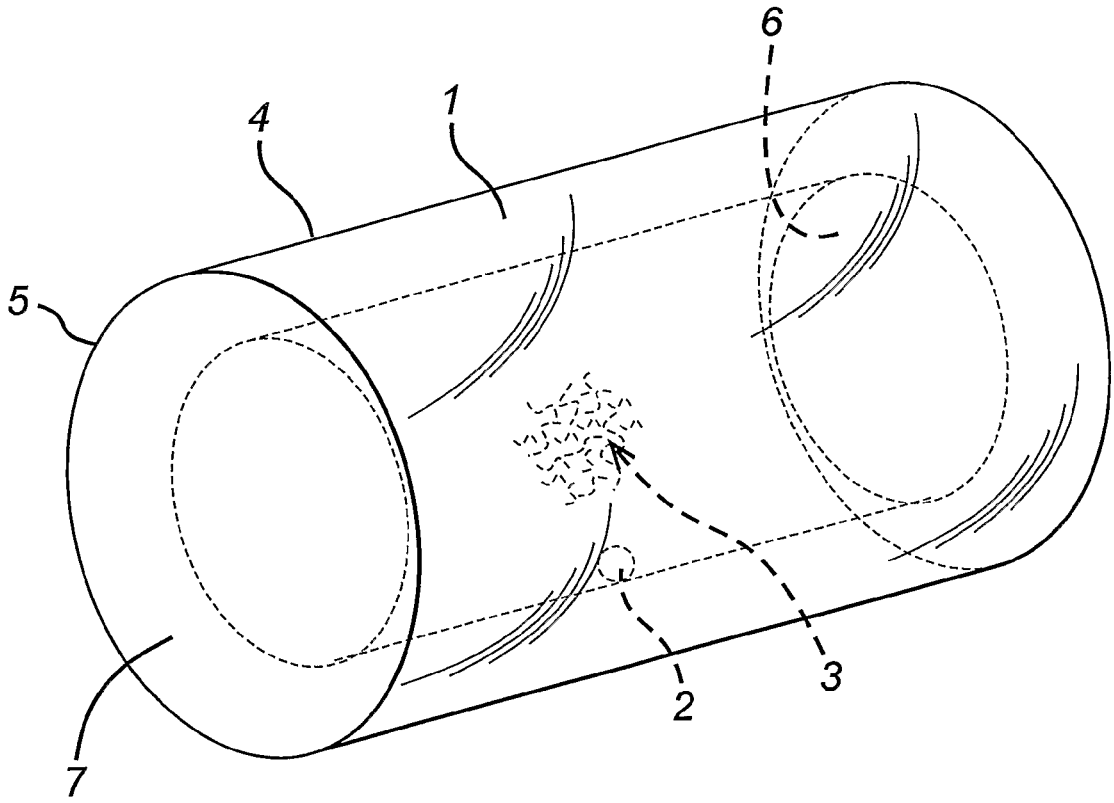
FIG. 1 is a perspective view of a bulb according to the invention.

Referring to the drawings, the bulb shown in FIG. 1 has a wall 1 of quartz and a fill of metal halide material 2—initially in pellet form—and noble gas 3, typically neon, argon, xenon or krypton. The wall is cylindrical along its length 4, with transverse ends 5. These are formed with flat inside surfaces 6 and flat outside surfaces 7. The former surfaces are made by heating and manipulating their material in a glass lathe in a known manner and the latter surfaces by grinding and polishing, also in a known manner. The bulb is formed in its length of precision bore and centrelessly ground and polished material, whereby the bulb is of a volume pre-determined by its external dimensions. Typically these are 12 mm long by 6 mm diameter.

Figure 2:
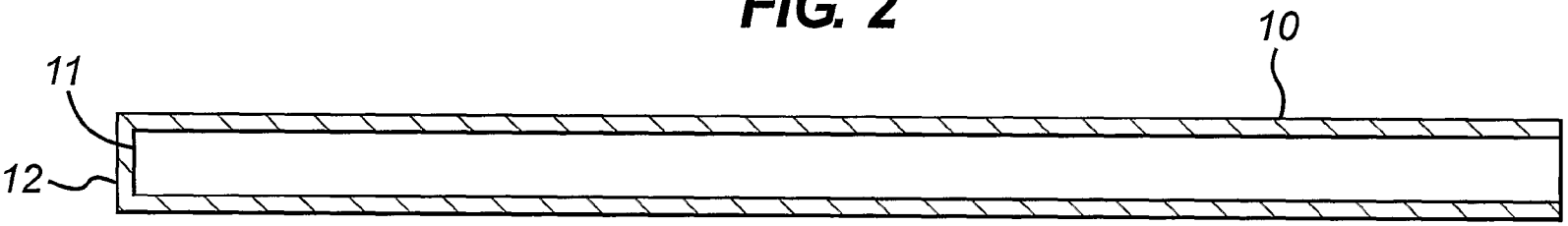
FIG. 2 is a diagrammatic side view of a piece of quartz tube, sealed at one end in preparation for production of the bulb of FIG. 1.
Figure 3:
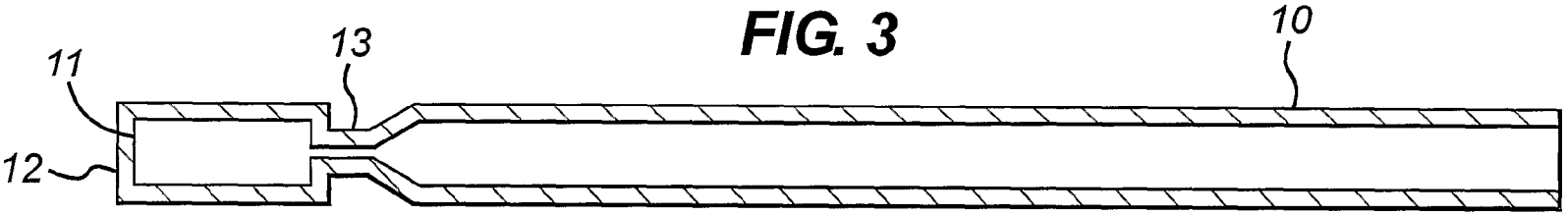
FIG. 3 is similar view of the quartz tube with a first neck formed preliminary to sealing.
Figure 4:
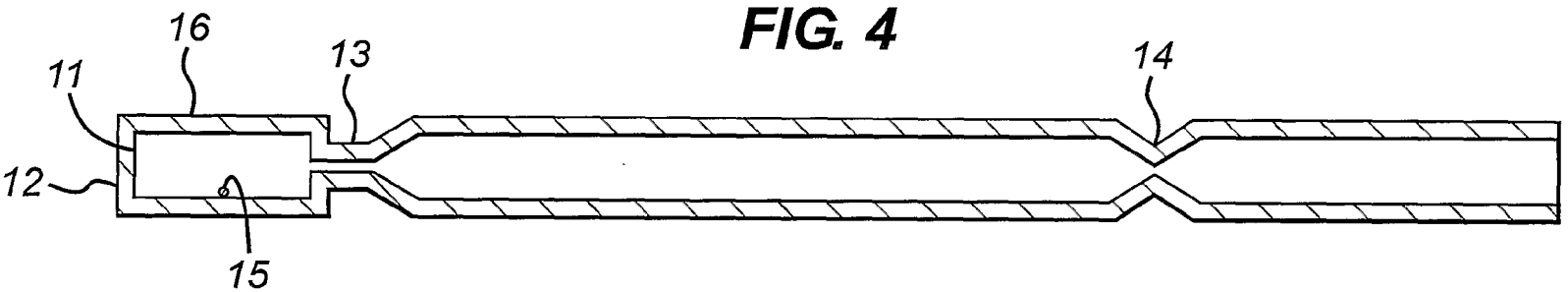
FIG. 4 is a similar view of the tube with two necks formed, preliminary to sealing.
Figure 5:
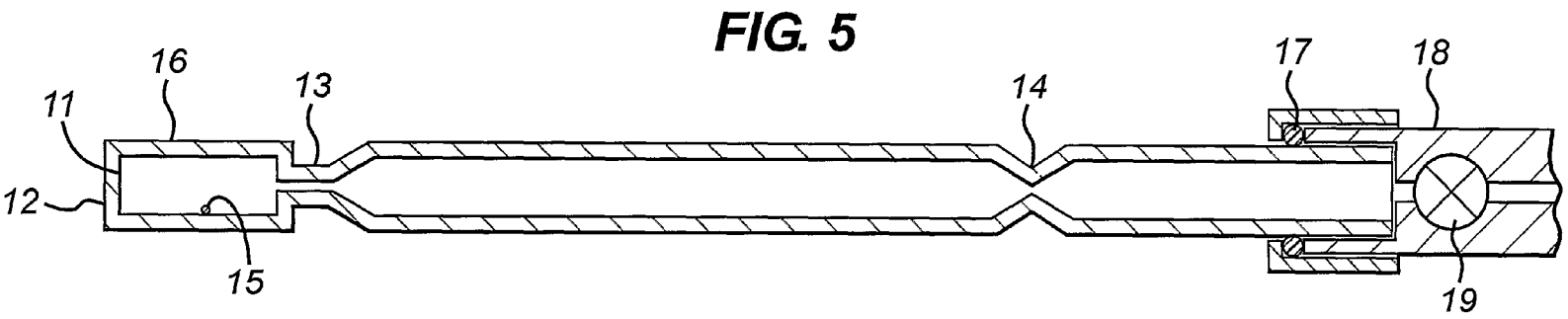
FIG. 5 is a further view of the tube with an evacuation fitting connected to its open end.
Figure 6:
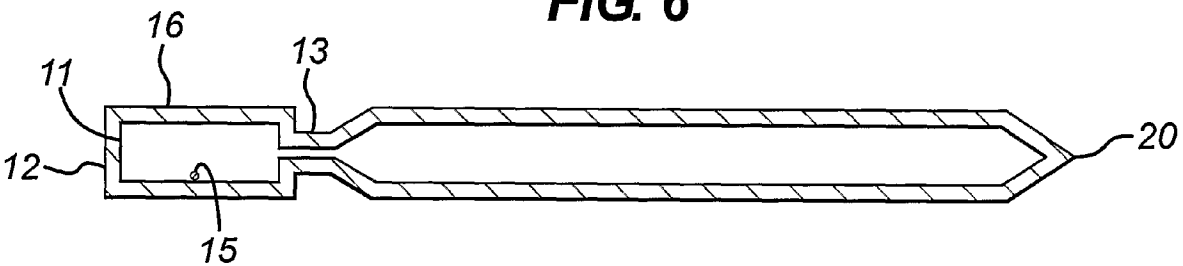
FIG. 6 is a diagrammatic side view of the tube after a first seal.
Figure 8:
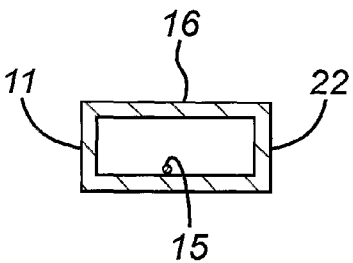
FIG. 8 is a similar view of the finished bulb.
Figure 7:
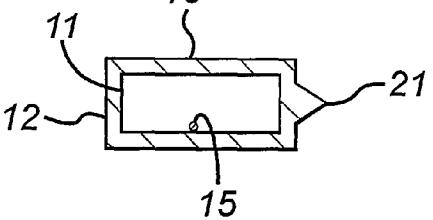
FIG. 7 is a similar view of the tube after a second seal.

Turning on to FIGS. 2 to 6, the bulb is formed from a length 10 of quartz tube, which starts approximately ten times its finished length. Typically, the 6 mm outside diameter tube has a 4 mm inside diameter. The steps in the manufacture of the bulb are as follows:

1. One end 11 is closed off and made flat 12, as shown in FIG. 2, in a glass lathe not shown.
2. A first neck 13 is formed in the tube close to the closed end, as shown in FIG. 3. This neck is positioned and formed to facilitate finishing the bulb to length.
3. A second neck 14 is formed in the tube, close to the still open end, as shown in FIG. 4, the first neck having been formed close to the closed end. The tube is removed from the lathe.
4. A metal halide pellet 15 of known size is dropped into the tube and rolled & tapped past the two necks 13,14. The tube is returned to the lathe. With the pellet in the portion 16 ending with the closed end 11, the tube is evacuated. This is effected with an O-ring 17 fitted on the precision ground outer surface of the tube. The O-ring is captivated in a fitting 18 having a valve 19 through which the tube can be evacuated and once evacuated refilled with noble gas, see FIG. 5. The fitting is supported in the tail stock of the lathe. Conveniently, the necks are formed in one lathe and the filling and sealing is performed in another lathe.
5. The quartz tube is sealed off at the second neck 14 before the fitting 18 is removed. Once the tube is sealed off, the metal halide and the noble gas is captivated in the tube. The fitting 18 is removed and the balance of the tube can be removed. The result is that with the pellet 15 on the first-closed-end side of the first neck 13, the sealing 20 is able to be effected at the second neck without risk of the metal halide vaporising and with the greater part of the noble gas fill not being heated. Thus the contents of the tube are well defined.
6. The first neck 13 is sealed off at 21, still with the metal halide pellet in the portion 16. The tube is worked to form the seal to the shape shown in FIG. 7. Should final sizing of the bulb result in the metal halide material vaporising during this operation, it is contained within a tube of known dimensions, whereby the amount coming to be trapped in the portion 16 is known. Whether it vaporises or not—as is preferred—under the final sealing conditions, the original quantity of metal halide ends in the portion 16.
7. The final step—not separately shown—is the polishing of the sealed and broken off end 19 to a smooth end 22.

Figure 9:
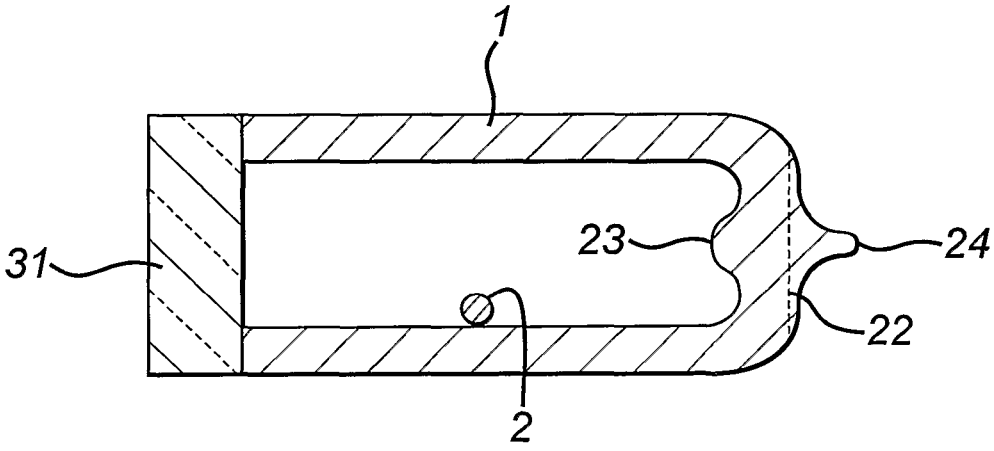
FIG. 9 is a large scale view of a variant of the bulb of FIG. 8.

Referring to FIG. 9, the right hand end of the bulb thereshown is formed essentially as just described, but the left hand end is differently formed. The right hand end has a small internal convexity 23, formed during inwards manipulation of the glass to ensure a good seal, and an external spike 24 formed by drawing of the unwanted portion of the tube away from the formed bulb. The external spike is ground off to the flat end 22. The internal convexity is provided to ensure that there is no concavity, which could cause the excitable material to condense in use away from the plasma to such extent that a small amount of the material only is vaporised, resulting in poor light output. However, where the external spike 24 acts as a heat sink, it can cause the convexity 23 inside it to function as a cold spot for such condensation, being at the end of the bulb with heat being coupled into the body of the metal halide/noble gas contents centrally of the bulb. In practice, the metal halide pellet is sized such that there is an excess of the material in the bulb, i.e. there is more than enough for the quantity required for a saturated vapour atmosphere of material in the bulb in operation. The balance accumulates on the cold spot 23, as the preferential condensation point, with the material evaporating from hotter points elsewhere in the bulb.

The left hand end of the tube is formed from a flat disc 31 of quartz glass, fused onto the tube. The flat disc enables light leaving the bulb to do so in a straight a line from the plasma formed centrally of the bulb in operation.

Figure 10:
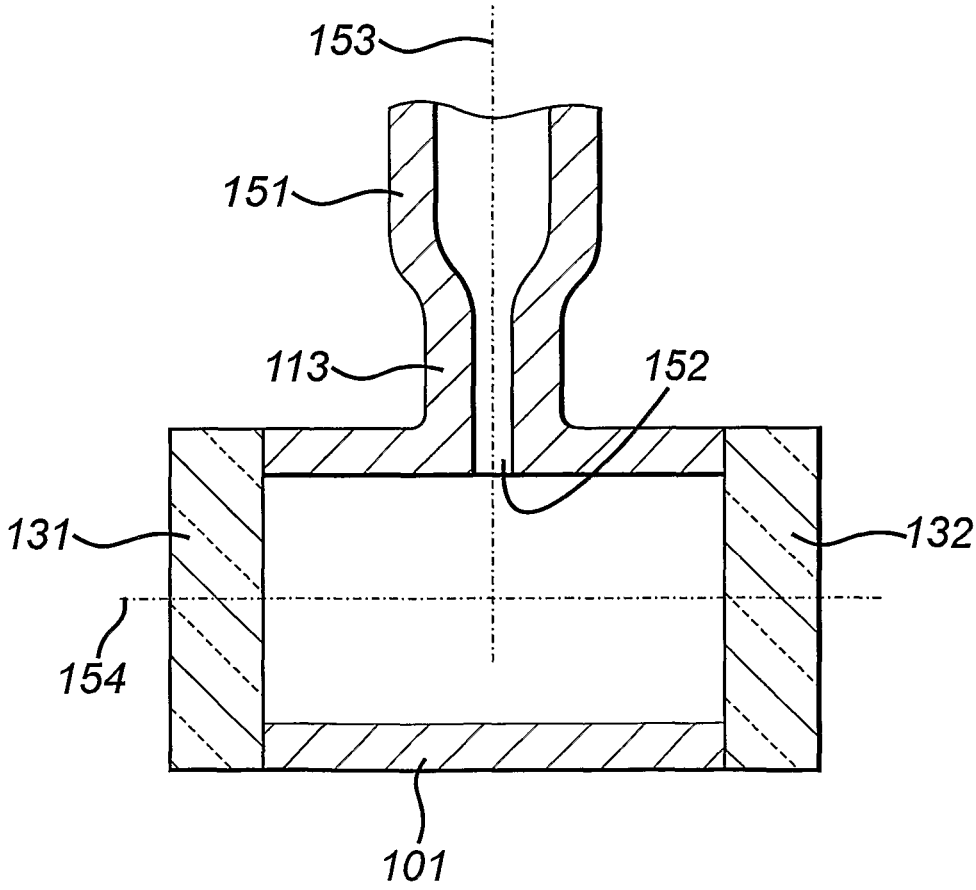
FIG. 10 is a view on the same scale as FIG. 9 of a partially formed bulb of the invention with a side branch.
Figure 11:
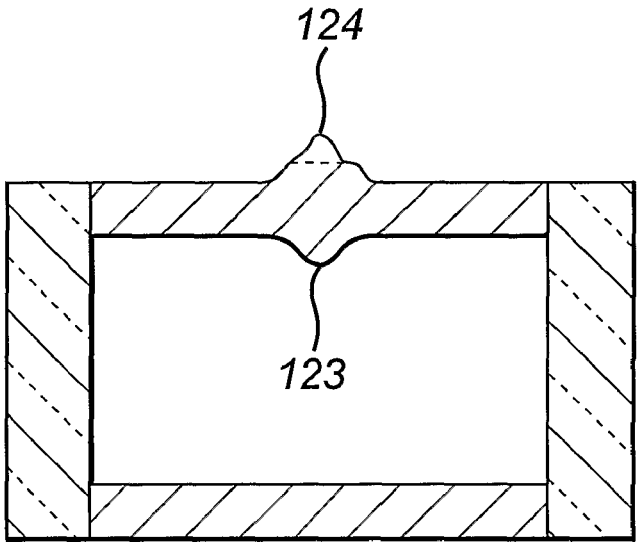
FIG. 11 is a similar view of the bulb of FIG. 10, fully formed.

FIGS. 10 and 11 show a second bulb, which is formed from a main bulb tube 101 and a slightly smaller diameter branch tube 151. The main tube is cut to length and has fused-on, flat disc ends 131,132. The branch tube has a first neck 113 and a second neck similar to the neck 14 in an extension of the tube not shown in FIG. 10. The neck 113 is at the junction of the bulb tube and the branch tube. An aperture 152 is provided in the wall of the bulb tube, for introduction of the metal halide pellet, evacuation and introduction of the noble gas. As with the in-line bulb tube and excess tube of the first bulb, with the axis 153 of the branch tube being truly radial from the axis 154 of the bulb tube, once the pellet has been introduced into the bulb tube via the branch tube and the aperture 152, the pellet will not roll out of the bulb tube under most orientations of the bulb tube, whereby manipulation of the bulb can be carried out with the branch tube horizontal, without risk of loss of the metal halide pellet.

As shown in FIG. 11, sealing of the bulb at the neck 113 results in an internal convexity 123 and an external spike 124, which can be ground off.

Figure 12:
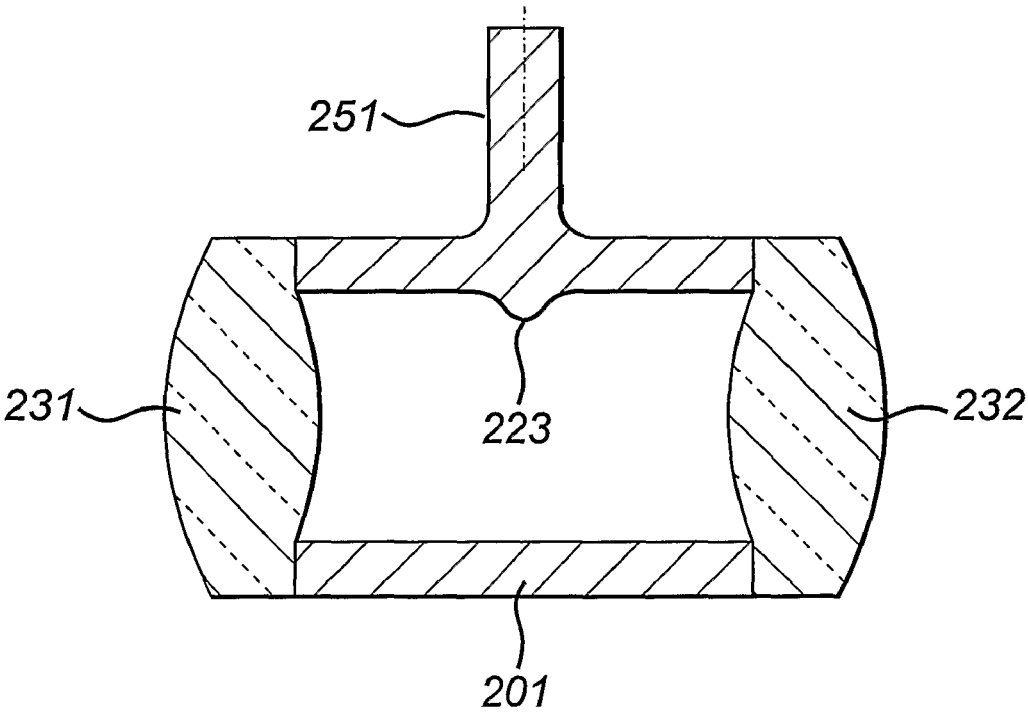
FIG. 12 is a similar view of a third bulb of the invention.

The third bulb shown in FIG. 12 has a bulb tube 201 and a vestigial branch tube or arm 251. The ends 231,232 of the bulb are lens shaped, having been formed to shape prior to fusing to the end of the tube 201. This is of advantage, over the flat ends of the bulb of FIG. 10, where it is advantageous to bring light from the bulb to a focus; whereas flat end bulbs are advantageous where collimated light is required.

The bulb 201 has a convexity 223 similar to the convexity 123. The vestigial branch tube arm 251 is formed in the process of sealing the branch tube. It is aligned with the convexity and adjacent to it. In use, the arm is accommodated in a ceramic wave-guide, which runs colder than the bulb. As such the arm provides a heat conduction path from the bulb and maintains the convexity colder than the rest of the bulb, whereby it can act as a condensation cold spot.

Figure 13:
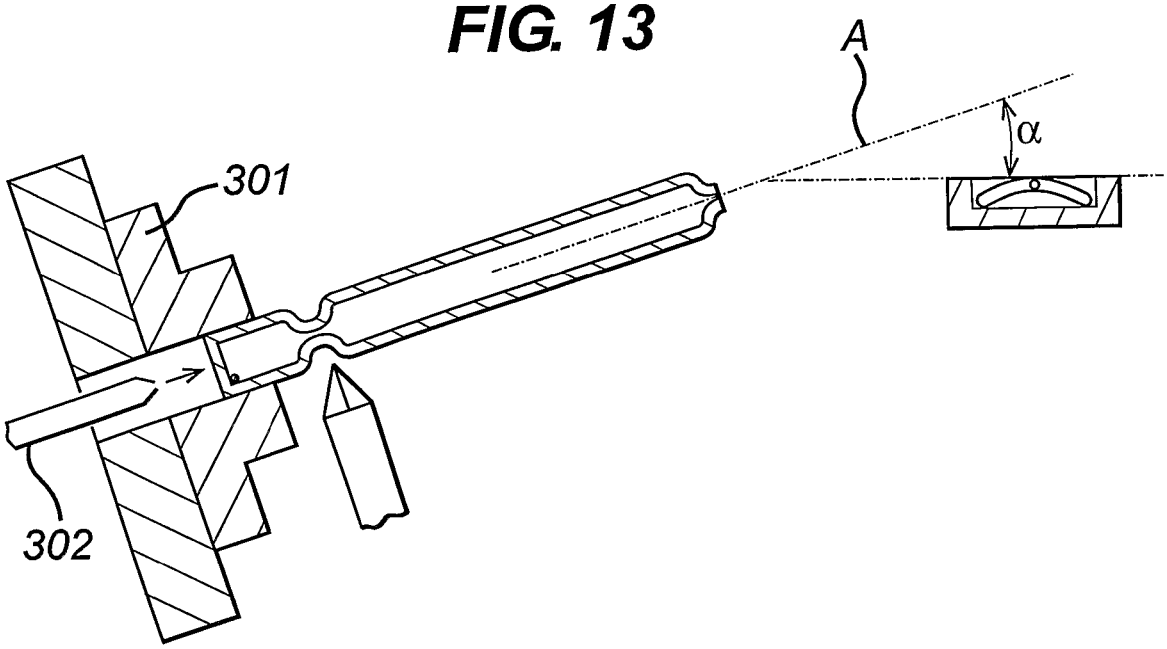
FIG. 13 is a diagrammatic view of a bulb being sealed in accordance with the invention in a glass lathe.
Figure 14:
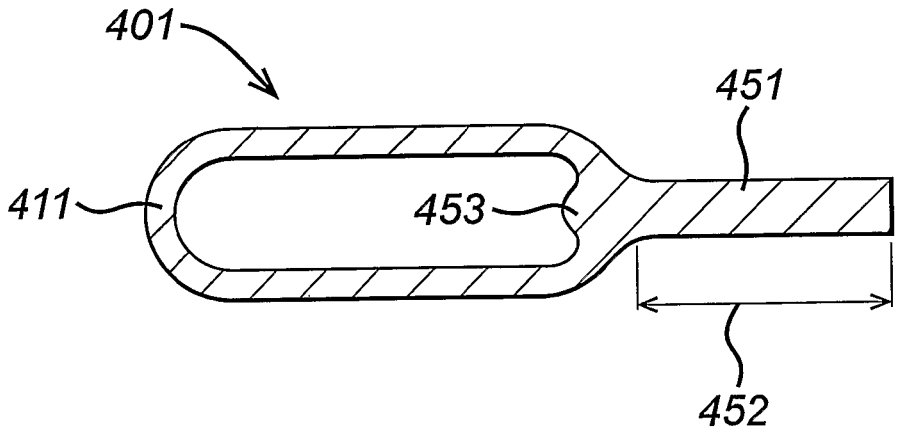
FIG. 14 is view of another bulb formed in accordance with the invention.

For forming bulbs described with reference to FIGS. 1 to 9, as shown in FIG. 13, the glass lathe, or at least the lathe used for sealing the bulb, may be arranged with its headstock/tailstock axis A inclined with tailstock above the headstock. This arrangement encourages the excitable material pellet to rest against the already closed end of the bulb, as shown in FIG. 13. A further possibility is that the bulb being sealed should be cooled with liquid nitrogen, to condense the noble gas fill contained with the bulb tube and the extension tube into the bulb to be formed during the sealing of the bulb. This can be effected by providing a nozzle 301 behind the chuck 302 holding the bulb and releasing a jet of liquid nitrogen from the nozzle onto the end of the bulb tube.

What is claimed is:

1. A method of making an electrodeless incandescent bulb, the method comprising the steps of:

providing a bulb enclosure of quartz glass;

forming an adjacent neck having a bore less than a transverse internal dimension of the bulb enclosure either:

integrally with the bulb enclosure or in a branch tube opening into the bulb enclosure;

forming a further neck remote from the adjacent neck, either in a tube extending integrally from the adjacent neck integral with the bulb enclosure or in the branch tube;

preparing the bulb for sealing by performing the following steps in direct sequence:

inserting at least one pellet of excitable material all the way into the bulb enclosure through the adjacent neck, evacuating the bulb enclosure through the adjacent neck and filling the bulb tube with inert gas, after evacuation and prior to sealing;

preliminarily sealing the bulb at the further neck; and finally sealing the bulb at the adjacent neck.

2. A method according to claim 1, wherein the inert gas is a noble gas.

3. A method according to claim 1, wherein the enclosure is a tube.

4. A method according to claim 3, including a step of blowing the enclosure including a closed end of the bulb tube, the closed end being flat or hemispherical and wherein the step of forming the adjacent neck includes:

formation of the neck remote from the closed end in the case of the adjacent neck being formed integrally in the bulb or closing off the other end of the bulb enclosure end in the case of the adjacent neck being formed in a branch tube.

5. A method according to claim 3, including a step of closing off at least one opening in the bulb tube preliminarily to sealing off the bulb and wherein the step of forming the adjacent neck includes:

formation of the neck remote from the closed end in the case of the adjacent neck being formed integrally in the bulb or closing off the other end of the bulb enclosure end in the case of the adjacent neck being formed in a branch tube.

6. A method according to claim 1, wherein an another end of the bulb tube is sealed by closure of the bulb tube with its own material.

7. A method according to claim 6, wherein the another end of the bulb tube is ground to form a lens.

* * * * *